US007784222B2

(12) United States Patent
Bennett

(10) Patent No.: US 7,784,222 B2
(45) Date of Patent: Aug. 31, 2010

(54) SIDING SYSTEM AND METHOD

(75) Inventor: Scott Bennett, Center City, MN (US)

(73) Assignee: Flashing By Design, Inc., Forest Lake, MN (US)

( * ) Notice: Subject to any disclaimer, the term of this patent is extended or adjusted under 35 U.S.C. 154(b) by 85 days.

(21) Appl. No.: 11/854,465

(22) Filed: Sep. 12, 2007

(65) Prior Publication Data

US 2009/0064599 A1 Mar. 12, 2009

(51) Int. Cl.
*E04D 1/36* (2006.01)

(52) U.S. Cl. ..... 52/58; 52/518; 52/748.1

(58) Field of Classification Search ..... 52/58, 52/169.5, 219, 211, 518, 748.1, 302.6
See application file for complete search history.

(56) References Cited

U.S. PATENT DOCUMENTS 1,624,121 A * 4/1927 Thiem ..... 52/371
2,249,125 A * 7/1941 Gabriel ..... 52/553
2,293,744 A * 8/1942 Miles et al. ..... 52/547
3,818,668 A 6/1974 Charniga
4,272,576 A * 6/1981 Britson ..... 428/100
4,348,849 A * 9/1982 Wollam et al. ..... 52/545
4,432,181 A * 2/1984 Funaki ..... 52/459
4,485,600 A 12/1984 Olson
4,622,791 A * 11/1986 Cook et al. ..... 52/241
4,757,651 A * 7/1988 Crites ..... 52/169.5
5,027,572 A 7/1991 Purcell et al.
5,218,793 A 6/1993 Ball
5,374,477 A 12/1994 Lawless et al.
5,553,434 A * 9/1996 Tamura ..... 52/545
5,564,245 A 10/1996 Rademacher
5,586,475 A 12/1996 Wenner
5,642,596 A * 7/1997 Waddington ..... 52/546
5,675,955 A * 10/1997 Champagne ..... 52/521
5,884,435 A 3/1999 David et al.

(Continued)

FOREIGN PATENT DOCUMENTS

JP 8-4248 1/1996

(Continued)

OTHER PUBLICATIONS

Simplicity Tool Corp. Off Stud Joiners.

(Continued)

*Primary Examiner*—Brian E Glessner
(74) *Attorney, Agent, or Firm*—Schwegman, Lundberg & Woessner, P.A

(57) ABSTRACT

A system for siding a building includes at least two siding pieces each including an end that abuts the other of the siding pieces, and a slip sheet. The slip sheet includes a lip that catches a top surface of at least one of the siding pieces. The slip sheet is positioned behind the at least two siding pieces and backing the abutting ends of the at least two siding pieces. The system also includes a trim flashing apparatus which further includes a trim portion that includes a visible surface and a surface to abut a portion of a siding piece, and a flashing portion attached to the trim portion. The flashing portion is sufficiently thin so that at least a portion of the flashing portion is covered by at least one of the two siding pieces.

18 Claims, 8 Drawing Sheets

U.S. PATENT DOCUMENTS

| | | | | |
|---|---|---|---|---|
| 5,894,697 | A * | 4/1999 | Hunter | 52/58 |
| 5,916,095 | A * | 6/1999 | Tamlyn | 52/58 |
| 6,050,041 | A * | 4/2000 | Mowery et al. | 52/520 |
| 6,052,959 | A * | 4/2000 | LaBrosse | 52/302.6 |
| 6,052,961 | A * | 4/2000 | Gibbs | 52/518 |
| D448,095 | S | 9/2001 | Merideth | |
| 6,305,130 | B1 | 10/2001 | Ackerman, Jr. | |
| 6,308,470 | B1 * | 10/2001 | Durkovic | 52/169.5 |
| 6,367,220 | B1 * | 4/2002 | Krause et al. | 52/512 |
| 6,393,792 | B1 * | 5/2002 | Mowery et al. | 52/520 |
| 6,474,032 | B1 * | 11/2002 | Wynn | 52/405.2 |
| 6,591,559 | B2 * | 7/2003 | Contreras et al. | 52/101 |
| 6,786,011 | B2 * | 9/2004 | Mares | 52/62 |
| 6,786,013 | B2 | 9/2004 | Coulton | |
| 6,883,282 | B1 * | 4/2005 | Newhart, III | 52/287.1 |
| 7,089,709 | B2 | 8/2006 | Waggoner | |
| 7,478,507 | B2 * | 1/2009 | Krause | 52/546 |
| 7,721,488 | B1 | 5/2010 | Bennett | |
| 2004/0074188 | A1 | 4/2004 | Beck et al. | |
| 2004/0093806 | A1 * | 5/2004 | Mares | 52/62 |
| 2004/0107663 | A1 | 6/2004 | Waggoner | |
| 2005/0204653 | A1 * | 9/2005 | Matthews | 52/169.5 |
| 2005/0229521 | A1 | 10/2005 | Morse | |
| 2006/0207197 | A1 * | 9/2006 | Anderson | 52/211 |
| 2007/0068093 | A1 * | 3/2007 | Grange et al. | 52/97 |
| 2007/0094958 | A1 * | 5/2007 | Rogers | 52/211 |
| 2008/0209834 | A1 * | 9/2008 | Ouellette et al. | 52/518 |

FOREIGN PATENT DOCUMENTS

| | | |
|---|---|---|
| JP | 10-280639 | 10/1998 |
| JP | 2007-16428 | 1/2007 |

OTHER PUBLICATIONS

Certainteed Weather Boards Lap Siding Installation Guide, Oct. 2008.
Simplicity Tool Corp. Installation Instructions for Off Stud Joiners.
BGC Duraplank Technical Information, Apr. 2007.
Technical Specification—External Cladding, Sep. 2005.
Scyon Stria Cladding Installation Instructions, Jun. 2008.
"U.S. Appl. No. 11/243,247 Response filed Dec. 8, 2008 to Final Office Action mailed Jun. 9, 2008", 12 pgs.
"U.S. Appl. No. 11/243,247, Non Final Office Action mailed Oct. 29, 2007", 9 pgs.
"U.S. Appl. No. 11/243,247, Non-Final Office Action mailed Mar. 6, 2009", 2 pgs.
"U.S. Appl. No. 11/243,247, Response filed Mar. 31, 2008 to Non-Final Office Action mailed Oct. 29, 2007", 9 pgs.
"U.S. Appl. No. 11/243,247, Response filed Jun. 4, 2009 to Non Final Office Action mailed Mar. 6, 2009", 13 pgs.
"U.S. Appl. No. 11/243,247, Final Office Action mailed Jun. 9, 2008", 13 pgs.
"U.S. Appl. No. 11/243,247 Final Office Action Mailed Sep. 2, 2009", 11 pgs.
"U.S. Appl. No. 11/243,247 , Notice of Allowance mailed Mar. 2, 2010", 4 Pgs.
"U.S. Appl. No. 11/243,247, Examiner Interview Summary mailed Jan. 20, 2010", 3 pgs.
"U.S. Appl. No. 11/243,247, Examiner Interview Summary mailed Jun. 8, 2009", 2 pgs.
"U.S. Appl. No. 11/243,247, Examiner Interview Summary mailed Dec. 9, 2008", 2 pgs.
"U.S. Appl. No. 11/243,247, Response filed Feb. 1, 2010 to Final Office Action mailed Sep. 2, 2009", 11 pgs.

* cited by examiner

SIDING SYSTEM AND METHOD

TECHNICAL FIELD

Various embodiments described herein relate to a flashing system, and methods associated with the flashing system.

BACKGROUND INFORMATION

Many buildings include external siding that protects the structure from the environment. The siding sheds rain, snow, hail, sun and many of the other environmental arrows in Mother Nature's quiver. The siding may also provide some rigidity to the structure. The siding also covers fiberboard, Styrofoam boards, sheeting and other less than aesthetically pleasing materials that are needed in the structure. The siding, when installed correctly, provides for an aesthetic look. One of the more challenging aspects of siding is keeping out water or minimizing the amount of water that can get behind the siding or get within the siding. Some siding material will absorb water. One example of siding material that absorbs water is concrete fiberboard type siding. This type of siding is becoming more popular because of its toughness and durability. When the siding material absorbs water, however, the siding can swell. If the siding then undergoes freezing temperatures, the moisture within the siding material can expand causing chipping of the siding. Even if the moisture does not freeze within the siding, the escaping moisture can cause removal of any paint on the surface of the siding. Such damage results in a consumer calling back the siding company or calling back the installer. Such call backs take time and many times are costly to correct.

As a result, many manufacturers have very specific installation instructions that must be followed to keep the warranty associated with the product in effect. The specific installation instructions are geared toward minimizing the siding product's exposure to water. For example, the siding must be a set distance from the roof, a set distance from the earth, and a set distance from concrete steps.

When installed per the manufacturer's instructions, many times the end result on the house may have exposed edges which are not aesthetically pleasing on a finished house. This can cause consumers to explore other options for siding.

BRIEF DESCRIPTION OF THE DRAWINGS

The invention is pointed out with particularity in the appended claims. However, a more complete understanding of the present invention may be derived by referring to the detailed description when considered in connection with the figures, wherein like reference numbers refer to similar items throughout the figures and:

DETAILED DESCRIPTION

Figure 1:
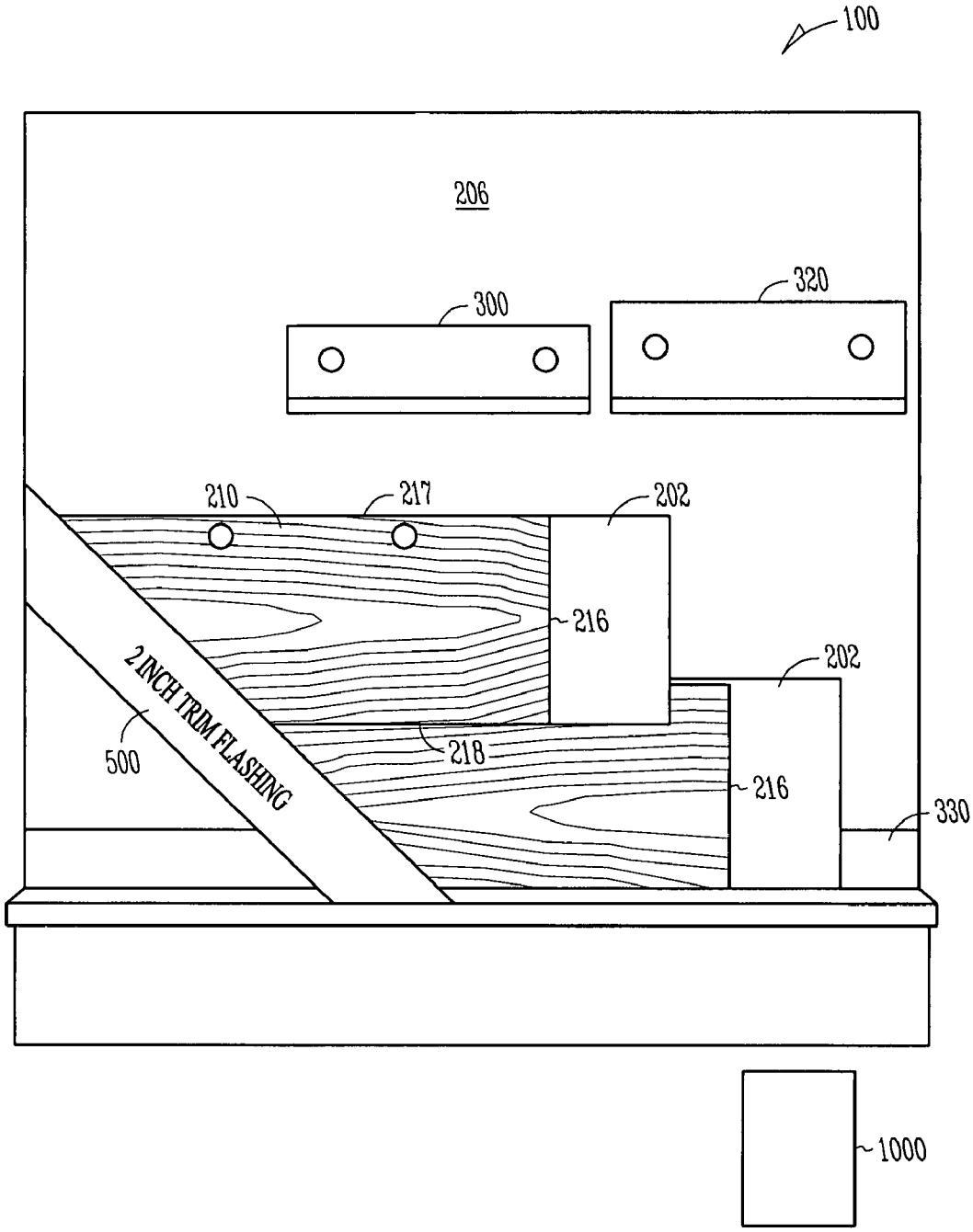
FIG. 1 is a perspective view of a siding system, according to an example embodiment of the invention.

FIG. 1 is a perspective view of a siding system 100, according to an example embodiment of the invention. The siding system 100 includes a plurality of siding pieces, such as siding piece 210, and a plurality of flashing pieces. The flashing pieces include a slip sheet 202, a trim flashing 500, a window flashing 300, a brick flashing 320 and an XLD flashing 330. A shortened length of siding 210 is shown in FIG. 1 for the purpose of illustration. The siding 210 generally comes in relatively long lengths such as 10-14 feet long. The siding also includes a top edge 217, a bottom edge 215 and an abutting edge 216. The trim flashing 500, the window flashing 300, the brick flashing 320, and the XLD flashing 330 are also shown in shortened lengths in FIG. 1. The trim flashing 500, the window flashing 300, the brick flashing 320, and the XLD flashing 330 would generally come in 8-10 foot lengths.

For siding a house, a kit could be sold that includes a plurality of siding pieces 210, a plurality of slip sheets 202, the trim flashing 500, the window flashing 300, the brick flashing 320 and the XLD flashing. The quantity of each of the siding pieces 210, the plurality of slip sheets 202, the trim flashing 500, the window flashing 300, the brick flashing 320 and the XLD flashing would be depend on the size of the building to be sided. In one embodiment, the siding pieces 210, the plurality of slip sheets 202, the trim flashing 500, the window flashing 300, the brick flashing 320 and the XLD flashing could be color coordinated. In still another embodiment, the siding pieces 210, the plurality of slip sheets 202, the trim flashing 500, the window flashing 300, the brick flashing 320 and the XLD flashing could be the same color. In either case, the slip sheets 202 could be the same color as the plurality of siding pieces 202 so that the building, after siding, would be one color since the siding pieces 210 and the slip sheets 202 would be the same color. The siding pieces would present one color even if abutting ends of the siding pieces 210 separated slightly either due to shrinkage in the product, settling of the building, or the like. In addition, a kit could also be as small as a display used to sell the siding system.

Figure 2:
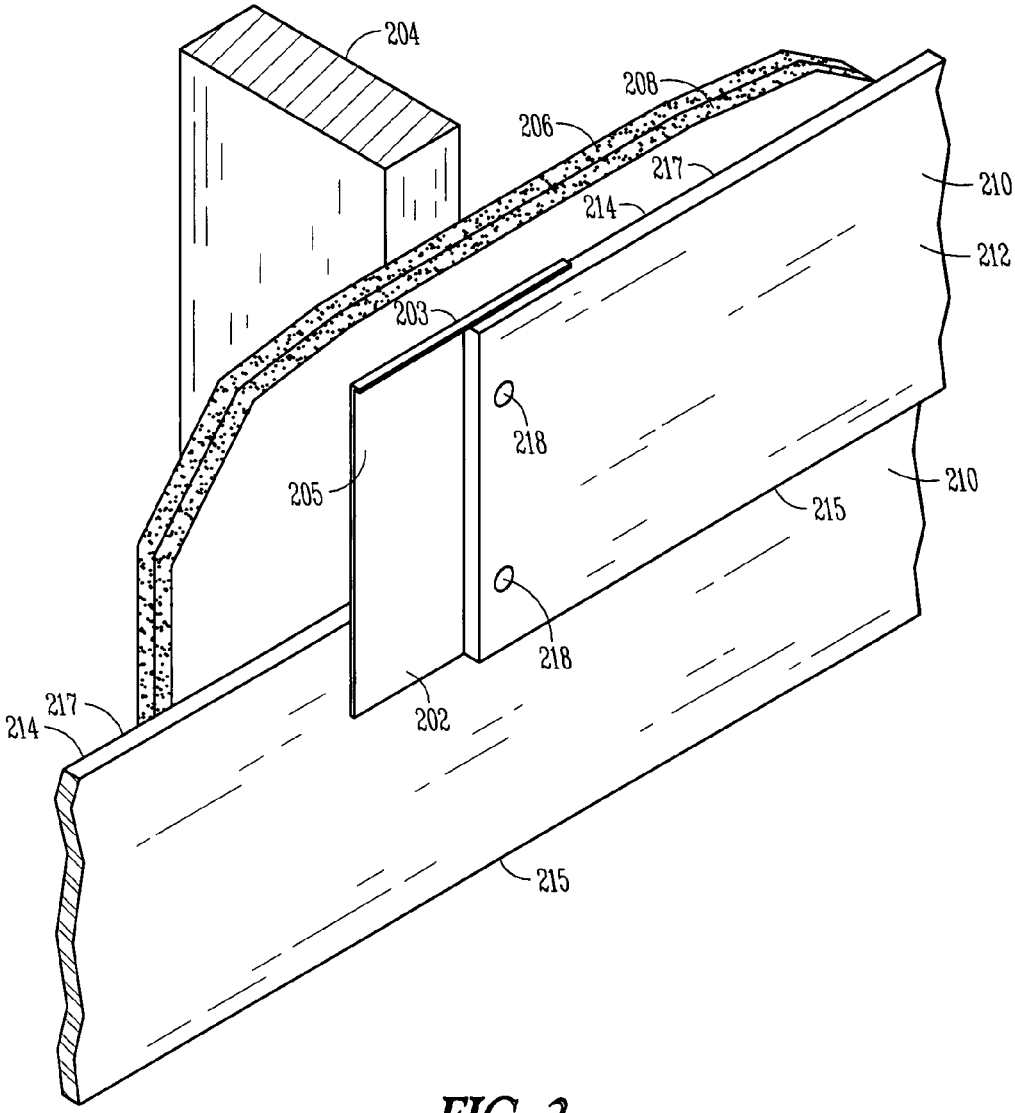
FIG. 2 shows a perspective view of the slip plate flashing apparatus as it is shown in use, according to an example embodiment.
Figure 3:
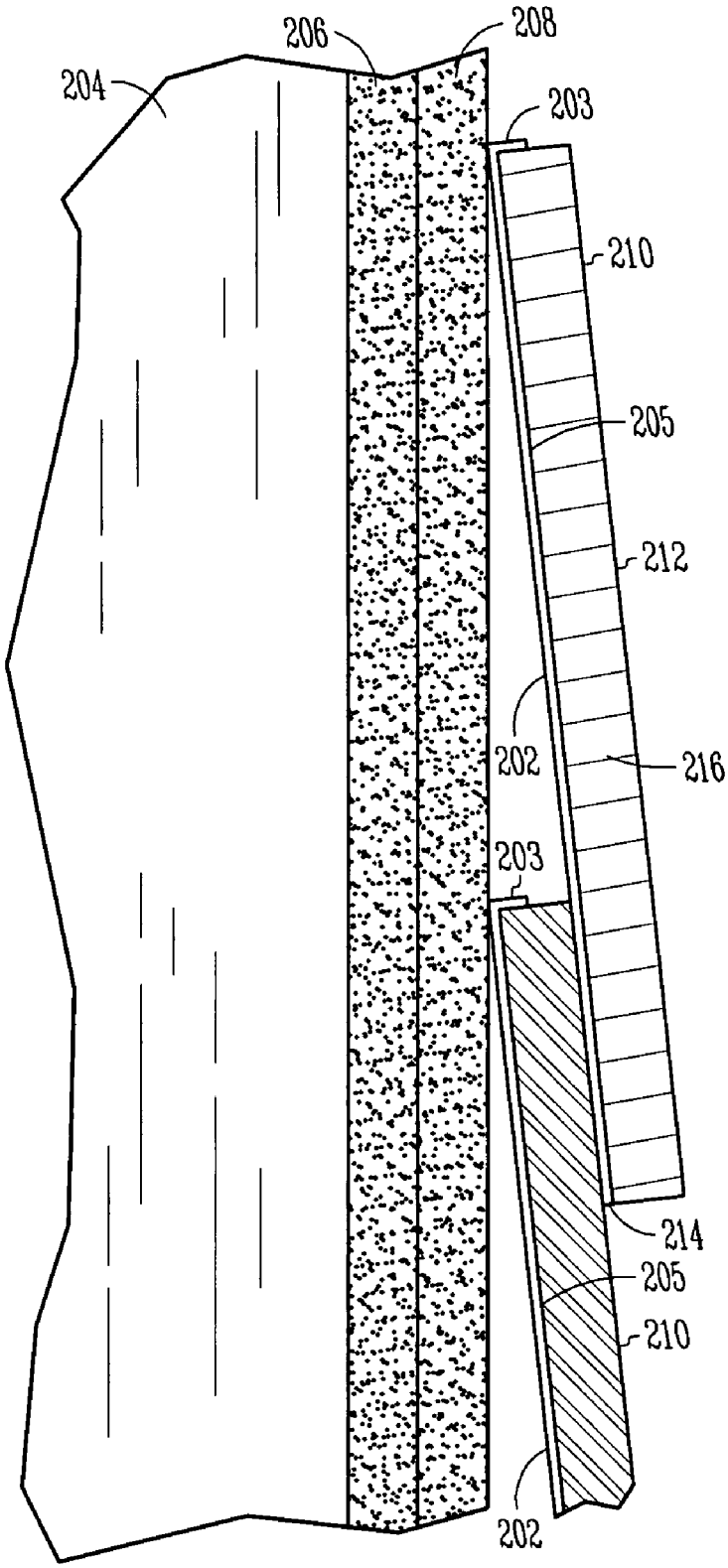
FIG. 3 shows a slide view of the slip plate flashing apparatus as it is shown in use, according to an example embodiment.
Figure 4:
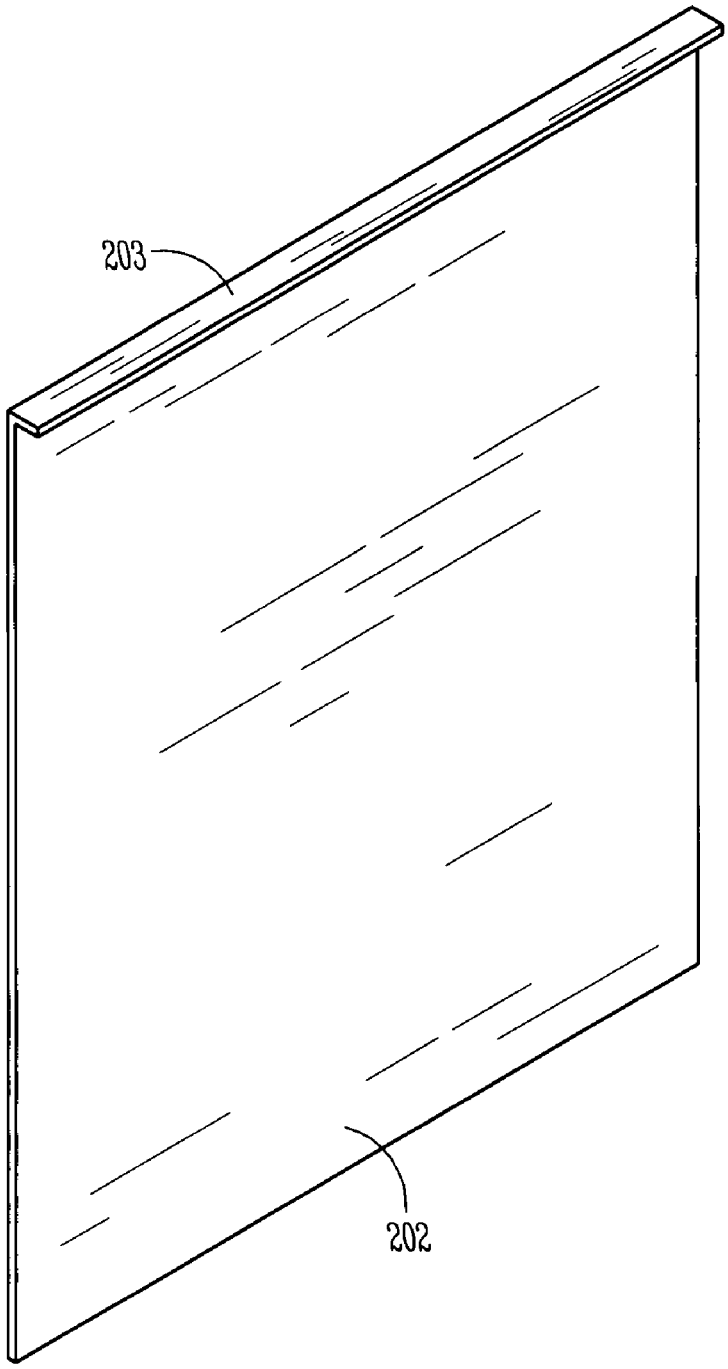
FIG. 4 shows a perspective view of the slip plate flashing apparatus, according to an example embodiment.

Now turning to FIGS. 2-4, the slip sheet 202 will be further detailed. As best illustrated in FIGS. 2 through 4, a number of construction components are utilized in conjunction with the slip sheet flashing apparatus 202 to show how the slip sheet flashing apparatus 202 interrelates with these items. First, a stud 204 is shown as structural support for a structure. The stud 204, in the completed product, would not be visible, as it serves as a structural framework within the structure. Attached to the stud 204 would be a layer of sheathing 206 and a weather resistant barrier 208. The sheathing 206 and barrier 208 could very well be incorporated into one item that is then fixedly attached to the stud 204.

Over the barrier 208 is then attached a plurality of fiber cement siding pieces 210. Each of the pieces has a length and a width, with the length being much longer than the width. The length and a width, with the length being much longer than the width. The length of each of the fiber cement siding pieces 210 is at least eight feet long, but can be longer as needed. Each of the fiber cement siding pieces 210 has a width that can vary widely, depending on the manufacturer and the particular use of look desired for a particular structure. Each fiber cement siding piece 210 also has two edges, a top edge 217 and a bottom edge 215.

When placed against the weather resistant barrier 208, the fiber cement siding pieces 210 are placed in parallel rows. Normally, when fiber cement siding 210 is placed against the barrier 208, it is angled in a way that allows the bottom edge 215 of a particular fiber cement siding piece 210 to overlap the top edge 217 of a fiber cement siding piece 210 that is below the first piece 210. In addition, all of the fiber cement siding pieces 210 on a structure are overlapped in such a manner that the "butt joints," which is the area where two adjoining fiber cement siding pieces 210 at the same level, are not at the same "vertical" location for each level. These characteristics ensure that the water dripping down against the exterior of a structure will not easily get behind the fiber cement siding pieces 210.

However, without the slip sheet flashing apparatus 202, it is possible that small amounts of water could get in between adjacent fiber cement siding pieces 210. However, proper use of the slip sheet flashing apparatus 202 in conjunction with the fiber cement siding pieces 210 will prevent this from happening.

The slip sheet flashing apparatus 202 includes a main body 205 and a lip 203. The main body 205 in one embodiment has a height of six (6) inches and has two edges, a top edge and a bottom edge. The main body 205 also has a width of anywhere between five and one-fourths (5¼) of an inch and twelve (12) inches. The fiber cement siding pieces 210 ideally has width dimensions of one of several different sizes, including 5¼, 6¼, 7¼, 8, 8¼, 9¼, and 12 inch widths.

Attached to the top edge of the main body 205 of the slip sheet flashing apparatus 202 is the lip 203. The lip 203 is attached to the top edge of the main body 205 at a substantially 90 degree angle and extends outward approximately one-fourth (¼) of an inch. when slip sheet flashing apparatus 202 is used in conjunction with two adjacent fiber cement siding pieces 210, the lip 203 is wrapped over the top edge 217 of each of the fiber cement siding pieces 210 before fasteners 218 are used to fixedly attach the fiber cement siding pieces 210 to the weather resistant barrier 208.

The lip 203 of each slip sheet flashing apparatus 202 essentially holds the slip sheet flashing apparatus 202 in place against the weather resistant barrier 208 and the fiber cement siding pieces 210, especially before the fasteners 218 have been used to fixedly attach the fiber cement siding pieces 210 to the weather resistant barrier 208. In addition, the presence of a slip sheet flashing apparatus 202 over each "butt joint" where two adjacent fiber cement siding pieces 210 meet each other will prevent water seepage through this area, thereby further protecting the weather resistant barrier 208, the sheathing 206, and the stud 204 from external moisture problems.

The slip sheet flashing apparatus 202 itself is preferably fabricated from galvanized steel. The slip sheet flashing apparatus 202 would come in a variety of colors, depending on the colors of fiber cement siding pieces 210 that are available. The slip sheet flashing apparatus 202 can also be formed in other various shapes and sizes as well.

Figure 5:
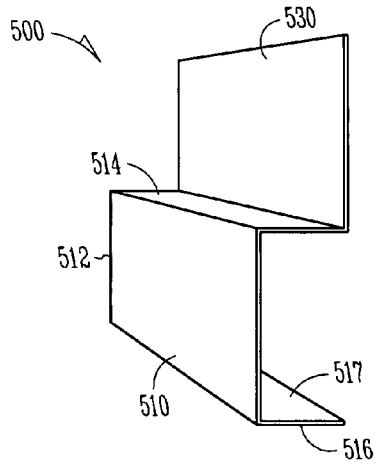
FIG. 5 is a perspective view of a trim flashing apparatus, according to an example embodiment of the invention.

FIG. 5 is a perspective view of a trim flashing apparatus 500, according to an example embodiment of the invention. The trim flashing apparatus 500 includes a trim portion 510 and a flashing portion 530. The trim portion 510 includes a portion that is substantially C-shaped. The trim flashing apparatus 500 could be made from metal or a plastic or a vinyl material. The trim flashing 500 will generally be color coordinated or at least have one surface that is color coordinated with respect to the plurality of siding pieces (such as shown in FIG. 1). The flashing portion 530 will be hidden when installed. The flashing fits beneath the siding and prevents water from seeping up behind the siding. The flashing will divert any water or will prevent water from going in back of the trim portion, or the C-shaped portion 510 of the trim flashing apparatus 500. The C-shaped portion or the trim portion 510 includes an exterior surface 512, another exterior surface 514 and still another surface 516. Surfaces 516 and the flashing 530 are generally hidden when installed. The surfaces 512 and 514 may be exposed or partially exposed when installed. The surface 516 may be a substantially straight piece of material as shown in FIG. 5. In other embodiments, however, the surface 516 will be terminated with a hem or slightly turned over portion at the edge 517 of surface 516. Such a hem provides added rigidity to the trim flashing apparatus 500 and also removes a possible sharp edge so that the trim flashing apparatus 500 is safer to handle for installers and all who handle the trim flashing apparatus 500.

Figure 6:
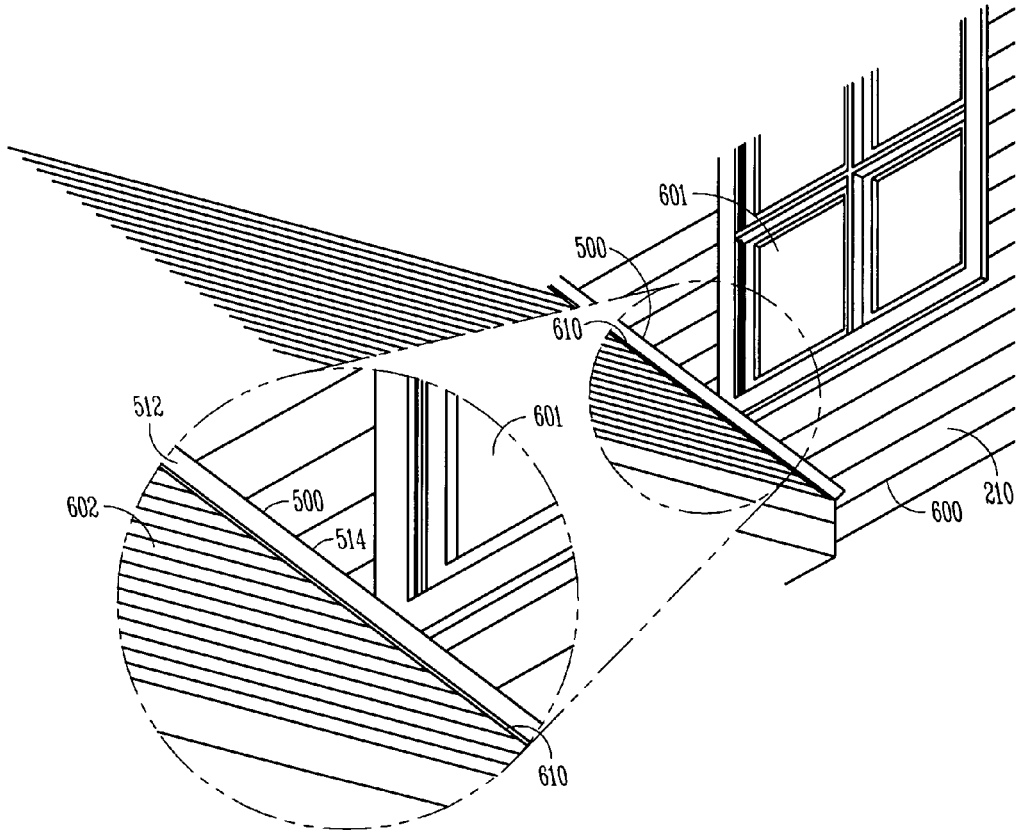
FIG. 6 is a perspective view of the trim flashing apparatus installed along a roof line, according to an example embodiment of the invention.

FIG. 6 is a perspective view of the trim flashing apparatus 500 installed along a roof line 610 of a building 600. The building 600 includes a window 601 and a roof 602. The building 600 also includes a plurality of siding pieces 210 which are installed over the sheathing (see FIG. 1) of the building. The trim apparatus 500 is placed right at the roof line or placed atop the roof 602. The individual pieces of siding can then be trimmed so as to lie flush with the surface 514 of the trim portion 510 of the trim flashing apparatus 500. As can be seen, the surface 514 and the surface 512 are color coordinated with respect to the siding 210. The width of the external edge 512 is sufficient to meet the specification set by the manufacturer. For example, if the individual pieces of siding 210 are to be placed at least two inches from the roof line or the roof 602, the width of the exterior face 512 of the trim apparatus is at least two inches so as to comply with the manufacturer's installation instructions. Thus, the trim flashing apparatus 500 allows for proper installation of the siding pieces and also provides for an aesthetically pleasing look to the finished job, such as along the roof or roof line shown in FIG. 6.

Figure 7:
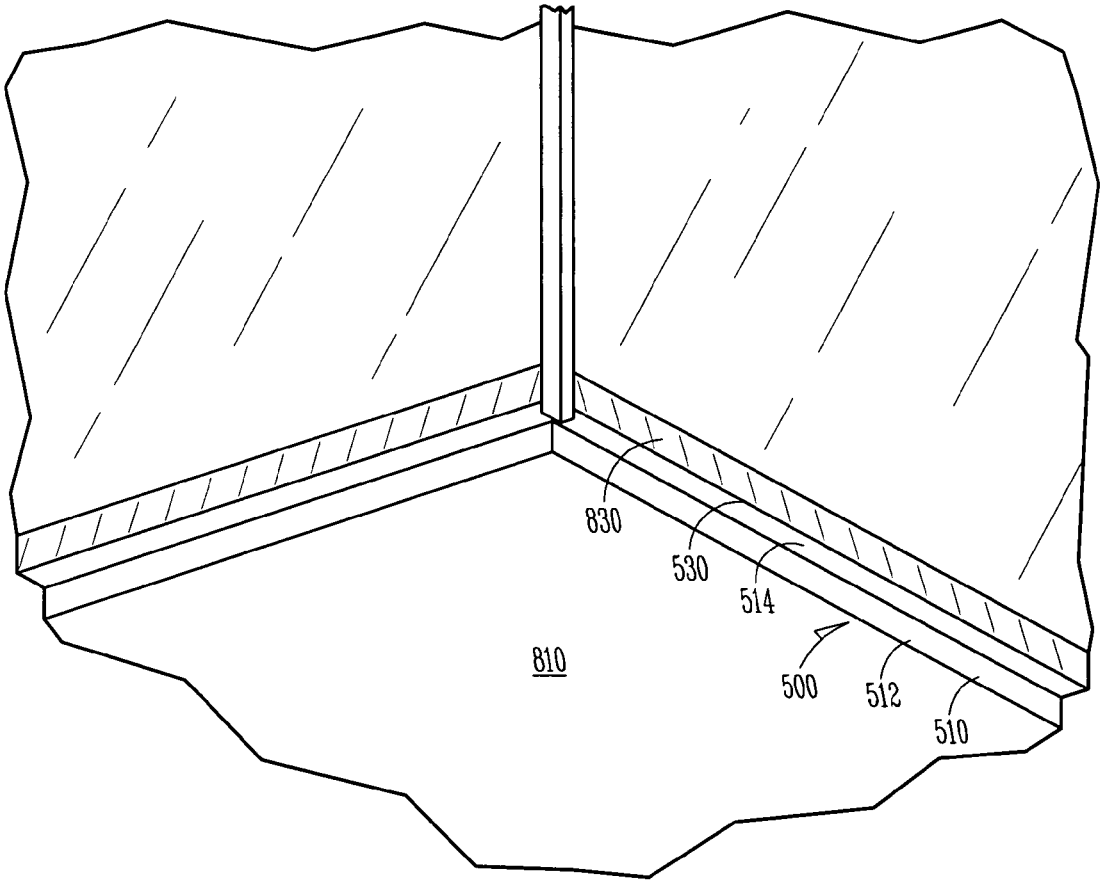
FIG. 7 is a perspective view of the trim flashing apparatus installed at a concrete pad, according to an example embodiment of the invention.
Figure 8:
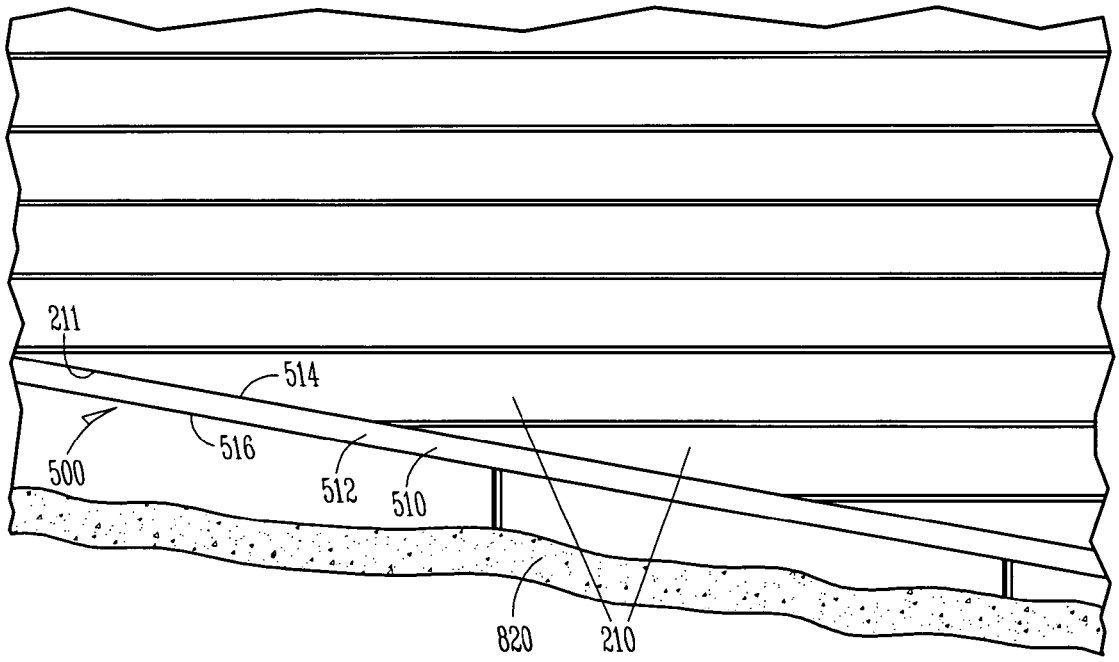
FIG. 8 is a front view of the trim flashing apparatus installed at grade, according to an example embodiment of the invention.

FIG. 7 is a perspective view of the trim flashing apparatus 500 installed on a concrete pad 810, according to an example embodiment of the invention. The trim flashing apparatus 500 includes an external trim portion 510 and the flashing portion 530. The flashing portion 530 is installed. As shown in FIG. 8, after fasteners are placed into the flashing portion 530 the fastener portion and the hole they produce is covered with a water sealing tape 830. The trim portion 510 is placed directly onto the concrete pad 810. In other words, the surface 516 (shown in FIG. 5) is placed directly onto the concrete pad 810. The exterior surface 512 and the exterior surface 514 are color coordinated with the individual siding pieces, such as siding piece 210 (shown in FIG. 6 and in FIG. 1).

FIG. 8 is a front view of a trim flashing apparatus 500 installed at grade, according to an example embodiment of the invention. As shown in FIG. 8, the grade is at 820. The grade is the level of the ground if you will with respect to the sidewall of a building. The trim flashing apparatus 510 is placed above the grade 820. The surface 516 faces the grade, while exterior surface 512 and surface 514 are exposed and color coordinated with the siding pieces 210. The cut edges, such as an edge 211 of a siding piece 210, can then be placed flush with the surface 514 of the trim flashing apparatus 500. This provides for an aesthetically pleasing look and also prevents the cut edge 211 from wicking either moisture from the air or water after installation.

A system 100 for siding a building includes at least two siding pieces 210 each including an end 216 that abuts the other of the siding pieces 210, and a slip sheet 202. The slip sheet 202 includes a lip 203 that catches a top surface or top edge 217 of at least one of the siding pieces 210. The slip sheet 202 is positioned behind the at least two siding pieces 210 and backs the abutting ends 216 of the at least two siding pieces 210. The system 100 also includes a trim flashing apparatus 500 which further includes a trim portion 510 that includes a visible surface 512 and a surface to abut a portion of a siding piece 514, and a flashing portion 530 attached to the trim portion 510. The flashing portion 530 is sufficiently thin so that at least a portion of the flashing portion 530 is covered by at least one of the two siding pieces 210. The system of may also include a window flashing 300, an XLD flashing 330, and a brick flashing 320. In one example embodiment, the visible portions of the slip sheet 202 and the at least two siding pieces 210 are substantially the same color. The slip sheet 202 has a width that is substantially equal to the length of at least one abutting end 216 of one of the two abutting ends. The trim flashing apparatus 500, according to one example embodiment, has a width at least equal to an offset dimension set forth by a siding manufacturer for the edges of the at least two siding pieces.

A kit includes a plurality of siding pieces 210 each including an end 216 that abuts an other of the plurality of siding pieces 210, and a plurality of slip sheets 202. The slip sheets 202 include a lip 203 adapted to rest on a top surface 217 of at least one of the plurality of siding pieces 210. The kit also includes a trim flashing apparatus 500 that has a trim portion 510 that includes a visible surface 512 and a surface 514 to abut a portion of a siding piece 210, and a flashing portion 530 attached to the trim portion. The flashing portion 530 is dimensioned to fit behind at least one of the siding pieces 210. The kit may include instructions 1000 (shown in FIG. 1) for installing the siding pieces 210 with at least one of the plurality of slip sheets 202 and a portion of the trim flashing apparatus 500. The kit may also include a window flashing 300, an XLD flashing 330, and a brick flashing 320. In one embodiment, the plurality of slip sheets 202 and the plurality of siding pieces 210 are substantially the same color. In one embodiment, the plurality of slip sheets 202 each have a width that is substantially equal to the length of a height of at least one of the plurality of siding pieces 210. In another embodiment, the trim portion 510 of the trim flashing apparatus 500 has a width at least equal to an offset dimension set forth by a siding manufacturer for the edges of the at least two siding pieces.

Figure 9:
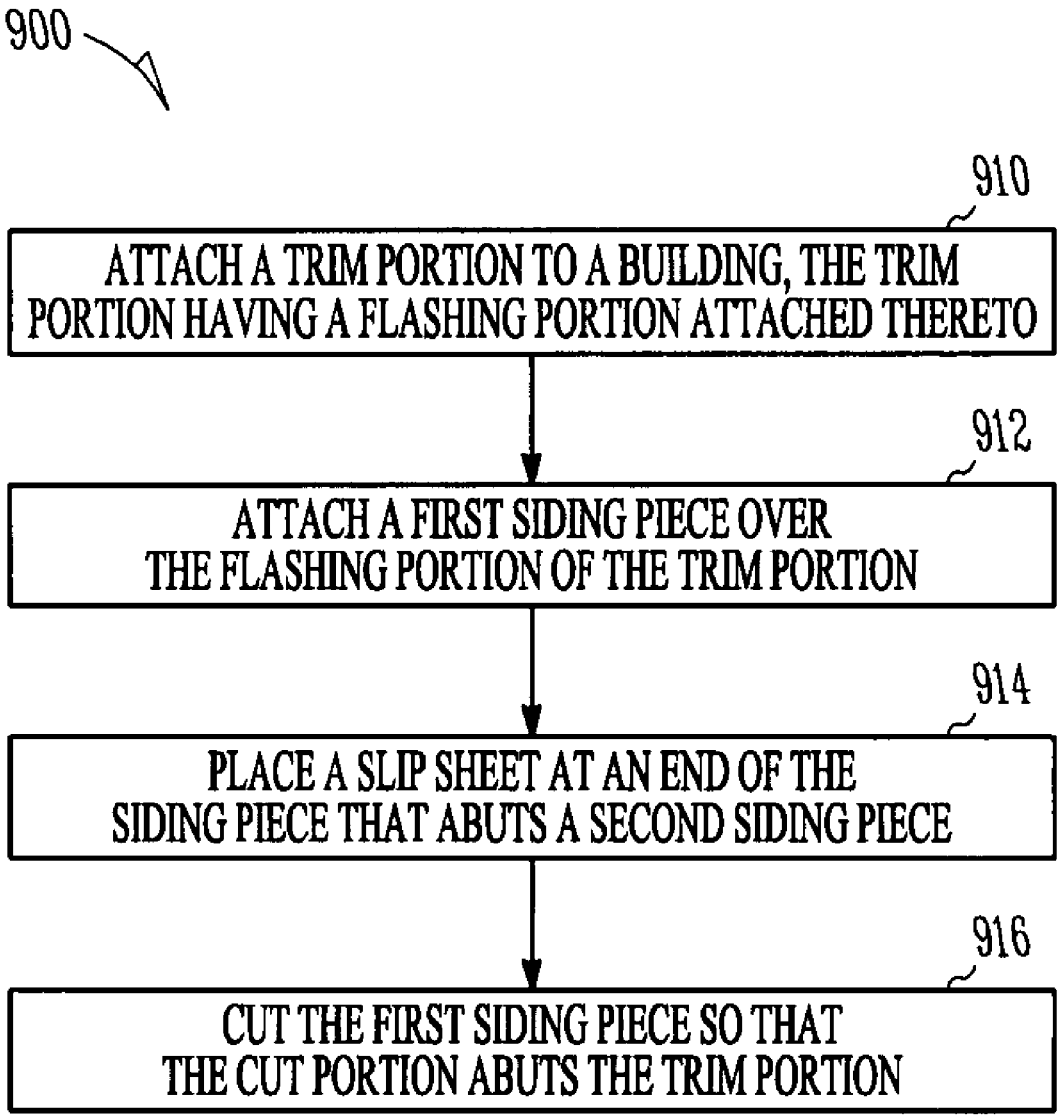
FIG. 9 is a flow diagram of a method for using a siding system, according to an example embodiment of the invention.

FIG. 9 is a flow diagram of a method 900 for using a siding system, according to an example embodiment of the invention. The method 900 includes attaching a trim portion to a building, the trim portion having a flashing portion attached thereto 910, attaching a first siding piece over the flashing portion of the trim portion 912, and placing a slip sheet at an end of the siding piece that abuts a second siding piece 914. The method 900 also includes cutting the first siding piece so that the cut portion abuts the trim portion 916. Attaching a trim portion to a building 910 includes attaching the trim portion along a roof line, above a grade associated with the building, or along a concrete pad.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments and other embodiments not specifically described herein will be apparent to those of skill in the art upon reviewing the above description.

The Abstract of the Disclosure is provided to comply with 37 C.F.R. §1.72(b) requiring an abstract that will allow the reader to quickly ascertain the nature of the technical disclosure. It is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into the Detailed Description, with each claim standing on its own as a separate embodiment.

What is claimed is:

1. A system for siding a building comprising:

at least two siding pieces each including an end that abuts the other of the siding pieces;

a slip sheet that includes a lip that catches a top surface of at least one of the siding pieces of the two siding pieces, the slip sheet positioned behind the at least two siding pieces and backing the abutting ends of the at least two siding pieces; and a trim flashing apparatus comprising:

a substantially C-shaped trim portion including a visible first surface, a second surface configured to abut a portion of a siding piece, and a third surface, wherein the second surface includes a front edge and a back edge, the second surface extending from a top edge of the visible first surface and being substantially perpendicular to the visible first surface, and the third surface extending from a bottom edge of the visible first surface and being substantially perpendicular to the visible first surface and substantially parallel to the second surface, the second surface being spaced from the third surface, wherein no portion of the third surface abuts the second surface, and wherein no other portion of the trim flashing apparatus other than the first surface extends between the second and third surfaces; and a flashing portion attached to the trim portion, the flashing portion sufficiently thin so that at least a portion of the flashing portion is covered by at least one of the two siding pieces, wherein the flashing portion extends from the back edge of the second surface of the trim portion in a direction away from the third surface of the trim portion, the flashing portion being substantially parallel to the visible first surface extending from the front edge of the second surface of the trim portion.

2. The system of claim 1 wherein at least portions of the slip sheet and the at least two siding pieces are substantially the same color.

3. The system of claim 1 further comprising a window flashing.

4. The system of claim 1 further comprising a brick flashing.

5. The system of claim 1 wherein the slip sheet has a width that is substantially equal to the length of at least one abutting end of one of the two abutting ends.

6. The system of claim 1 wherein the visible first surface of the trim portion of the trim flashing apparatus has a width of about two inches, the width being a distance between the top and bottom edges of the visible first surface.

7. A kit comprising:

a plurality of siding pieces each including an end adapted to abut the other of the siding pieces;

a plurality of slip sheets that include a lip adapted to rest on a top surface of at least one of the plurality of siding pieces; and a trim flashing apparatus comprising:

a substantially C-shaped trim portion including a first visible surface, a second surface adapted to abut a portion of a siding piece, and a third surface, wherein the second surface includes a front edge and a back edge, the second surface extending from a top edge of the visible first surface and being substantially perpendicular to the visible first surface, and the third surface extending from a bottom edge of the visible first surface and being substantially perpendicular to the visible first surface and substantially parallel to the second surface, the second surface being spaced, wherein no portion of the third surface abuts the second surface, and wherein a front edge of the third surface is attached to the bottom edge of the first surface, the third surface cantilevering from the bottom edge of the first surface, the third surface being unattached to any other portion of the trim flashing apparatus; and a flashing portion attached to the trim portion, the flashing portion dimensioned to fit behind at least one of the siding pieces, wherein the flashing portion extends from the back edge of the second surface of the trim portion in a direction away from the third surface of the trim portion, the flashing portion being substantially parallel to the visible first surface extending from the front edge of the second surface of the trim portion.

8. The kit of claim 7 further including instructions for installing the siding pieces with at least one of the plurality of slip sheets and a portion of the trim flashing apparatus.

9. The kit of claim 7 wherein at least portions of the plurality of slip sheets and the plurality of siding pieces are substantially the same color.

10. The kit of claim 7 further comprising a window flashing.

11. The kit of claim 7 further comprising a brick flashing.

12. The kit of claim 7 wherein the plurality of slip sheets each have a width that is substantially equal to the length of a height of at least one of the plurality of siding pieces.

13. The kit of claim 7 wherein the trim portion of the trim flashing apparatus has a width of about two inches.

14. A method comprising:

attaching a trim flashing apparatus to a building, the trim flashing apparatus including a trim portion and a flashing portion attached to the trim portion, the trim portion being substantially C-shaped and including a first visible surface, a second surface adapted to abut a portion of a siding piece, and a third surface, wherein the second surface includes a front edge and a back edge, the second surface extending from a top edge of the visible first surface and being substantially perpendicular to the visible first surface, and the third surface extending from a bottom edge of the visible first surface and being substantially perpendicular to the visible first surface and substantially parallel to the second surface, the second surface being spaced, wherein no portion of the third surface abuts the second surface, the flashing portion dimensioned to fit behind at least one of the siding pieces, wherein the flashing portion extends from the back edge of the second surface of the trim portion in a direction away from the third surface of the trim portion, the flashing portion being substantially parallel to the visible first surface extending from the front edge of the second surface of the trim portion, and wherein a front edge of the third surface is attached to the bottom edge of the first surface, the third surface cantilevering from the bottom edge of the first surface, the third surface being unattached to any other portion of the trim flashing apparatus;

attaching a first siding piece over the flashing portion of the trim portion; and placing a slip sheet at an end of the siding piece that abuts a second siding piece.

15. The method of claim 14 that includes cutting the first siding piece so that the cut portion abuts the trim portion.

16. The method of claim 14 wherein attaching a trim portion to a building includes attaching the trim portion along a roof line.

17. The method of claim 14 wherein attaching a trim portion to a building includes attaching the trim portion above a grade associated with the building.

18. The method of claim 14 wherein attaching a trim portion to a building includes attaching the trim portion along a concrete pad.

* * * * *